US007404553B2

(12) United States Patent
Steinhilber

(10) Patent No.: US 7,404,553 B2
(45) Date of Patent: Jul. 29, 2008

(54) PROCEDURE AND DEVICE FOR SEPARATION OF SHEETS OF A MEDIUM

(76) Inventor: Helmut Steinhilber, Sonnenberg Strasse 40, CH-6052 Hergiswil (CH)

( * ) Notice: Subject to any disclaimer, the term of this patent is extended or adjusted under 35 U.S.C. 154(b) by 206 days.

(21) Appl. No.: 10/923,652

(22) Filed: Aug. 20, 2004

(65) Prior Publication Data

US 2005/0040582 A1 Feb. 24, 2005

(30) Foreign Application Priority Data

Aug. 21, 2003 (DE) ..... 103 38 365

(51) Int. Cl.
*B65H 3/24* (2006.01)

(52) U.S. Cl. ..... 271/42; 271/34

(58) Field of Classification Search ..... 271/100, 271/105, 106, 34, 104, 121, 122, 42, 208; 414/796.5, 795.8, 790
See application file for complete search history.

(56) References Cited

U.S. PATENT DOCUMENTS

| | | | | | |
|---|---|---|---|---|---|
| 3,095,193 | A | * | 6/1963 | Sorenson | 271/42 |
| 4,013,283 | A | * | 3/1977 | Tress et al. | 271/14 |
| 4,313,703 | A | * | 2/1982 | Fabrig | 414/796.1 |
| 4,457,658 | A | * | 7/1984 | Meylan | 414/796 |
| 4,516,762 | A | * | 5/1985 | Moltrasio et al. | 271/11 |
| 4,620,827 | A | * | 11/1986 | Sameshima et al. | 414/796 |
| 4,623,292 | A | * | 11/1986 | Suzuki et al. | 414/796 |
| 4,637,600 | A | * | 1/1987 | Bartimes et al. | 271/93 |
| 5,011,126 | A | * | 4/1991 | Suzuki et al. | 271/227 |
| 5,074,743 | A | * | 12/1991 | Schaffner et al. | 414/790.8 |
| 5,657,618 | A | * | 8/1997 | Dall'Omo et al. | 53/504 |
| 5,971,389 | A | * | 10/1999 | Golicz et al. | 271/34 |
| 6,048,119 | A | * | 4/2000 | Kato et al. | 400/624 |
| 6,227,534 | B1 | | 5/2001 | Schoedinger et al. | 271/114 |
| 6,779,793 | B2 | * | 8/2004 | Behrens et al. | 271/283 |
| 2003/0189281 | A1 | * | 10/2003 | Larsen et al. | 271/42 |
| 2004/0150153 | A1 | * | 8/2004 | Kang | 271/122 |

FOREIGN PATENT DOCUMENTS

| | | | |
|---|---|---|---|
| DE | PS 493 270 | | 3/1930 |
| DE | DBP 1147242 | | 8/1964 |
| DE | 30 05 933 | A1 | 9/1981 |
| DE | 3419056 | A1 * | 12/1984 |
| DE | 41 12 379 | A1 | 10/1992 |
| DE | 92 12 466 | U1 | 3/1994 |
| DE | 44 44 836 | A1 | 6/1996 |
| DE | 100 16 793 | C2 | 7/2002 |
| EP | 0 534 245 | B1 | 9/1992 |
| JP | 62240237 | A | 10/1987 |
| WO | WO 89/03798 | | 5/1989 |

* cited by examiner

*Primary Examiner*—Patrick H. Mackey
*Assistant Examiner*—Jeremy R Severson
(74) *Attorney, Agent, or Firm*—Baker Botts L.L.P.

(57) ABSTRACT

Sheets (12, 14) of a medium stored in a stack (10) are separated and fed into an office machine. The edge of the top sheet (12) is lifted off the corresponding edge of the following second sheet (14). At least one separator (26) is inserted into the gap (32) resulting from the lifting of the top-sheet (12) and the top sheet (12) is lifted by the separator from the following sheet (14). This causes a reduction of the friction between the top sheet (12) and the following sheet (14) during separation of the top sheet (12), so that the electrical charge of the sheets (12, 14) generated by this friction is minimized.

20 Claims, 2 Drawing Sheets

PROCEDURE AND DEVICE FOR SEPARATION OF SHEETS OF A MEDIUM

PRIORITY

This application claims priority to German application no. 103 38 365.4 filed Aug. 21, 2003.

TECHNICAL FIELD OF THE INVENTION

The present invention relates to a procedure for the individual feed of media sheets as well as a device for the individual feed of media sheets.

DESCRIPTION OF RELATED ART AND BACKGROUND OF THE INVENTION

Most office machines such as copiers, printers and similar devices generally use media in sheet form. This media, generally paper sheets, is normally stored in stacks. From this stack, individual sheets are pulled and fed into the office machine. By pulling the top-most sheet off the stack, friction between the top-most and the following sheet in the stack is generated. This friction causes an electrostatic charge of the touching sheets. This electrostatic charge depends on the environmental conditions like temperature and humidity as well as the sheets' surface and material characteristics. The electrostatic charge causes the sheets to stick to each other, which can make separating the top-most sheet from the stack difficult.

SUMMARY OF THE INVENTION

The invention is based on the task to reduce the interfering influence of the electrostatic charge in order to be able to pull single sheets from the stack.

The invention solves this task by a procedure for separation of sheets of a medium for feeding to an office machine, with which the sheets are kept in a stack and the top-most sheet of the stack is lifted from the following sheet on the stack at the front edge facing the transport direction and then fed to the office machine, comprising the steps of moving at least one elongated separator from the front side of the stack facing the feed direction into a gap which is formed by the lifted edge of the top sheet and the corresponding edge of the following sheet, and pushing the separator in the opposite direction of the feed direction between the top sheet and the following sheet, in order to separate the top sheet from the surface of the following sheet, while the top sheet is lifted.

The top sheet may rest at least partially on a separator while it is being fed to the machine. At least one separator may conduct electricity and can be grounded. The at least one separator can be driven by a motor.

The object can also be achieved by a device for separation of sheets of a medium for feeding to an office machine, with which the sheets are kept in a stack and the top-most sheet of the stack is lifted from the following sheet on the stack at the front edge facing the transport direction and then fed to the office machine, comprising: devices for lifting the front edge of the top sheet facing the feed direction from the following sheet, and at least one tongue-shaped band separator at the front side of the stack facing the feed direction which can be pushed from the front edge of the stack in the opposite direction of the feed direction into the gap formed by the lifted edge of the top sheet and the following sheet, in order to separate the top sheet from the following sheet, while the top sheet is lifted.

A pusher may grab the top sheet and the top sheet may be pushed against the sheet stopper, which lifts the edge of the top sheet. The pusher can be a flex device which traverses the top sheet with freely movable feed rollers. The sheet stopper may comprise at least one continuously moving belt and the pusher may push the top sheet with its edge against the part of the at least one belt that moves upwards substantially vertically to the sheet plane. The tongue-shaped band can be a steel band of small material thickness with a cross-section profile that causes an axial stiffening of the band. The separator can be equipped with a gliding tip. At least one separator can be so long that it can be inserted in feed direction almost over the entire length of the stack. Two separators can be used at certain distances to each other and perpendicularly to the stack's edge. The at least one separator may conduct electricity or may use a conducting coating and can be grounded. The at least one separator can be driven by a motor. The motor drive of the at least one separator can be controlled in such a manner, that the separator is inserted at high speed between the top sheet and the following sheet and is removed from the inserted position to the home position at a speed that corresponds to the pull-off speed of the top sheet.

The main idea of the invention is to insert at least one separator between the top-most sheet and the following second sheet in the stack, before the top-most sheet is pulled from the stack. By using a separator, the top-most sheet is separated from the following sheet's surface. When the top-most sheet is pulled from the stack, the friction between the top-most and the following sheet is considerably reduced.

By using a separator, the top-most sheet is at least partially lifted off the following sheet. Doing so enables air to enter the space between the top-most and the following sheet. The air works as a pad, on which the top-most sheet can float and can be pulled effortlessly and without much friction.

In one preferred embodiment, the top-most sheet can be lifted off the following sheet almost entirely due to at least one separator. This reduces the friction between the top-most and the following sheet during the paper feed and minimizes the electrostatic charge caused by the friction.

In one preferred embodiment, the separator has the shape of an elongated tongue which is inserted into the gap created by the edge of the top-most sheet and the following sheet. The tongue-shaped separator can be so long that it covers the entire length of the sheets that need to be separated. The separator separates the top-most sheet on its entire length from the following sheet. In order to achieve optimum separation over the width of the sheet as well, two or more tongue-shaped separators are to be used. These separators are inserted parallel to each other and side by side over the width of the stack. This ensures that the top-most sheet is separated from the following sheet more or less over its entire surface area. When the topmost sheet is pulled off the stack, it basically rests on the tongue-shaped separators, almost completely preventing it from causing friction with the following sheet.

In one advantageous embodiment, the separator (at least one) is an electrical conductor and is grounded. All generated electrostatic charges are then derivated via the separator and/or separators. To do so, the separator can consist of or can be plated with a metal that conducts electricity.

In one preferred embodiment, the tongue-shaped separator consists of a metal band, especially a steel band. This band can be of minimal material thickness, which ensures low mass inertia of the separator. Due to the curving of the band's cross-section profile a sufficient rigidity of the tongue-shaped separator can be achieved even at a small material thickness, as known from steel measuring tapes. Due to the low mass and rigidity of the tongue-shaped separator, the separator can be inserted between the sheets using a motor and at high speeds, so that the separation cycle is not slowed down by separator insertion.

The procedure according to the invention can be used for all known separation applications, for which one edge of the top sheet is first lifted off the following sheet, so that a gap between the top sheet and the following sheet is created along this edge. The separator can be inserted into this gap.

BRIEF DESCRIPTION OF THE DRAWINGS

The invention is further explained below using the embodiment shown in the figure. The figures show.

DETAILED DESCRIPTION OF THE PREFERRED EMBODIMENTS

Figure 1:
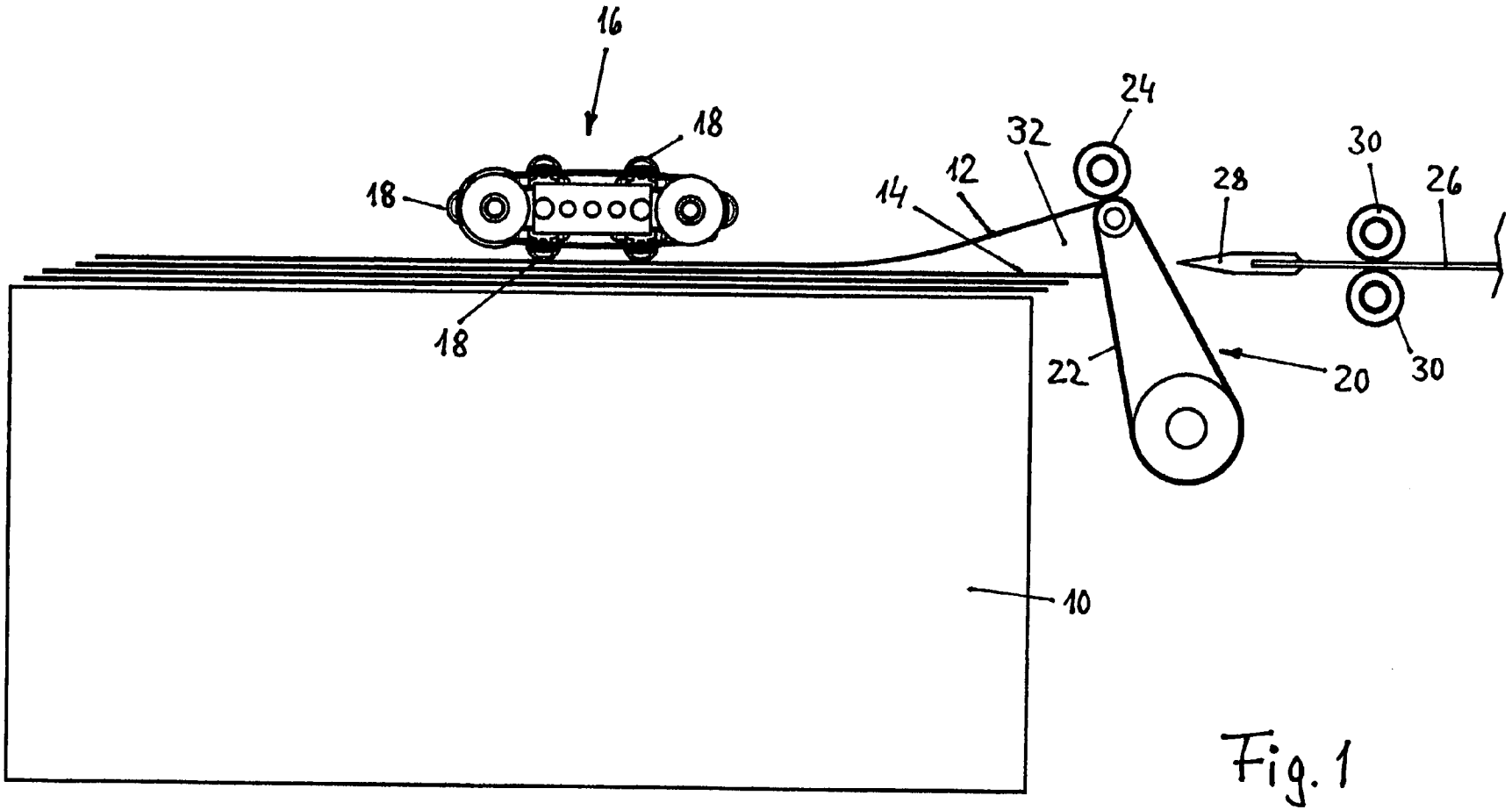
FIG. 1 a side view of a separation by using a separator at the beginning of the separation procedure, and FIG. 2 a corresponding view with the separator inserted.

In order to feed media (e.g. paper sheets) to an office machine such as a printer or copier, the sheets are stored in a stack 10. The top sheet 12 of stack 10 is separated from the following second sheet 14 in the stack and fed to the office machine (not depicted).

If a sheet is about to be fed to the machine, a command-controlled pusher 16 is set onto the top sheet 12 of stack 10. The pusher 16 in the embodiment depicted is a flex device such as is described in DE 100 16 793 C2. The pusher 16 is equipped with feed rollers 18 on a belt that is constantly moving. The feed rollers are moved under pressure over the top sheet 12 in the direction of the paper feed, i.e. from left to right in the figure. The feed rollers 18 apply pressure on the top sheet 12 and reduce pressure on the following sheets in the stack. By using this pressure, the top sheets 12, 14 etc. in stack 10 are pushed forward in a scale-like fashion, i.e. the top sheet 12 is pushed forward the strongest, the following sheets 14 etc. increasingly less. This scale-like fanning of the top sheets of stack 10 can be seen in FIG. 1.

In the feed direction of the sheets 12, 14 etc. in front of the stack 10, there is a sheet stop 20. The pusher 16 moves the sheets towards this stop. In the embodiment shown, the sheet stop consists of the constantly driven belt 22. Several of these belts can be found distributed along the front end of stack 10. at certain distances from each other. In the figure, the belts 22 are moving in a clockwise direction. The part of the belts 22 which is positioned towards the stack 10 moves upward vertically in front of the front edge of stack 10.

Due to the scale-like fanning of the upper sheets on stack 10 achieved by the pusher 16, the front edge of top sheet 12 (i.e. the right edge in the figure) reaches the belts 22 first. Due to the fact that the front edge of the top sheet 12 contacts the upward-moving part of the belts 22 because of the pusher's 16 pushing pressure, the front edge of the top sheet 22 is being moved upwards by the belts 22 and is lifted from the front edge of the following sheet 14, as shown in FIG. 1. The upper part of the upward-moving part of the belts 22 slightly deviates from the vertical, so that it is slightly inclined towards the stack 10. This leaves the front edge of the top sheet 12 under pushing pressure and contacting at the belts 22, even if the front edge of the top sheet 12 moves up.

Figure 2:
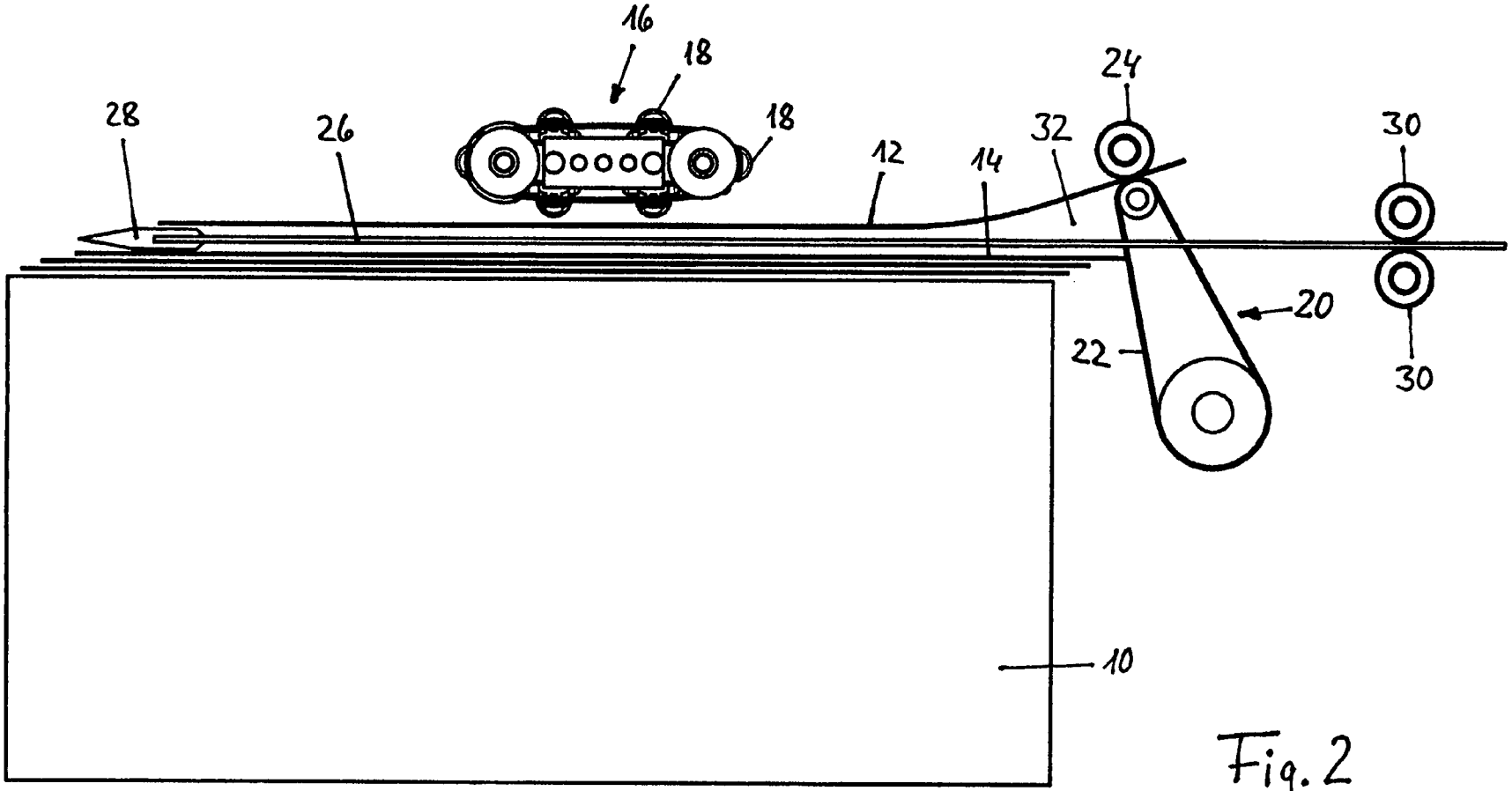

The upper deflection rollers of the belts 22 are fitted with counter rollers 24 from above. When the front edge of the top sheet 12 reaches the upper deflection point when conveyed by the belts 22, the front edge of the top sheet 12 is grabbed by the upper deflection rollers of the belts 22 and the counter rollers 24 and transported in the direction of the feed, as shown in FIG. 2. The top sheet 12 is pulled from the stack 10 and separated from the following sheet 14 and fed into the office machine.

In order to prevent the friction between the top sheet 12 and the following sheet 14 during pulling of the top sheet 12 from the stack 10 creates an electrostatic charge between these sheets 12 and 14 and an electrostatic adhesion of the sheets, the device described below is used.

One or more separators 26 are located in front of the stopper-side front edge of the stack 10. The separators 26 are shaped like elongated, tongue-shaped bands. In the preferred configuration, the separators are narrow steel bands of low material thickness with a cross-section profile that is slightly vaulted in order to give these steel bands the necessary axial rigidity. Steel bands such as these are used in measuring tape applications, for example. A gliding tip 28 (plastic, felt or similar) can be put on top of the separator 26 ends facing the stack 10 in order to prevent the sheets from being damaged by the separator 26.

The tongue-shaped separators 26 are placed in such a manner in front of stack 10, that their length axis corresponds to the direction of the paper feed through the pusher 16. During standby, which is shown in FIG. 1, the separators' 26 plastic tips 28 are outside of the stack 10, with the vertical position of the plastic tips 28 corresponding to the upper edge of stack 10. From the standby position as depicted in FIG. 1, the separators 26 can be driven by motor and moved against the stack 10. The drive is shown in the figure by command-controlled driven friction rollers 30 which frictionally engage the steel band of the separators 26 and advance it. The length of the separator 26 is such that the separators can reach the back edge of the stack 10 with their plastic tip 28 when they are pushed forward against the stack (in the figure towards the left). In the preferred configuration, two separators 26 are used. They are offset perpendicularly in relation to the plane and to the front edge of stack 10 and are located at positions which correspond to a third or to two thirds, respectively, of the width of stack 10. The separators 26 are aligned with the belt 22 gaps, so that they can be moved between the belts 22 towards the stack 10.

When the office machine issues a sheet request, the pusher 16 is activated and put on the top sheet 12 of stack 10. The top sheet 12 is pushed by the pusher 16 towards the belts 22 of sheet stopper 20. The upward-moving belts 22 lift the front edge of the top sheet 12 from the offset following front edge of the following sheet 14, as shown in FIG. 1. This creates a gap 32 between the front edge of the top sheet 12 and the front edge of the following sheet 14.

As soon as a sensor senses that the front edge of the top sheet 12 is captured between the upper deflection roller of the belts 22 and the counter rollers 24, as shown in FIG. 2, the pusher 16 is lifted off the top sheet of the stack, and the separators 26 are pushed at high speed by the friction rollers 30 from the standby position depicted in FIG. 1 to the left and against the stack 10. The plastic tips 28 penetrate the gap 32 between the top sheet 12 and the following sheet 14 and the ribbon-shaped separators 26 are inserted over the entire length of the stack between the top sheet 12 and the following sheet 14, as shown in FIG. 2.

Since the two separators 26 are inserted between the top sheet 12 and the following sheet 14, the top sheet 12 is separated on its entire surface area from the following sheet 14. When the top sheet 12 is pulled off, it rests mainly on the separators 26 and not on the following sheet 14, so that the friction between the top sheet 12 and the following sheet 14 is reduced considerably and no electrostatic charge is created. If a residual friction remains and a small electrostatic charge is generated, it is deviated via the conducting steel bands of the separators 26. For this reason, they are grounded at the end not visible in the figure.

Once the separators 26 have reached their final position as shown in FIG. 2, in which they have separated the top sheet 12 from the following sheet 14, the separators are removed until they reach the standby position as shown in FIG. 1, in which they are ready for the next separation cycle. The separators are inserted at a high speed between the top sheet 12 and the following sheet 14, so that the top sheet 12 can be separated as fast as possible from the second sheet 14 once the top sheet has been grabbed by the counter rollers 24. The return movement of the separators 26 to the standby position is executed at a lower speed and is synchronous to the pull speed of the top sheet 12, so that there is no relevant relative speed difference between the top sheet 12 and the separators 26.

I claim:

1. A method for separation of sheets of a medium for feeding to a machine, wherein the sheets are kept in a stack for feeding to the machine in a feed direction, the method comprising:

advancing the top sheet of the stack in the feed direction further than the following sheet on the stack such that the top sheet interacts with a lifting system;

after advancing the top sheet in the feed direction further than the following sheet, the lifting system lifting a front edge of the top sheet of the stack from the following sheet on the stack, wherein a significant non-edge portion of a bottom surface of the top sheet remains in contact with a top surface of the following sheet;

moving at least one elongated separator from a front side of the stack facing the feed direction into a gap formed between the lifted edge of the top sheet and the corresponding edge of the following sheet; and moving the separator in the opposite direction of the feed direction between the top sheet and the following sheet in order to substantially separate the bottom surface of the top sheet from the top surface of the following sheet.

2. The method according to claim 1, wherein the top sheet rests at least partially on the at least one separator while it is being fed to the machine.

3. The method according to claim 2, wherein at least one separator conducts electricity and is grounded.

4. The method according to claim 1, wherein at least one separator conducts electricity and is grounded.

5. The method according to claim 1, wherein the at least one separator is driven by a motor.

6. A method for separation of sheets of a medium for feeding to a machine, wherein the sheets are kept in a stack for feeding to the machine in a feed direction, the method comprising:

advancing the top sheet of the stack in the feed direction further than the following sheet on the stack such that the top sheet interacts with a lifting system;

after advancing the top sheet in the feed direction further than the following sheet, the lifting system lifting a front edge of the top sheet of the stack from the following sheet on the stack such that the top sheet bows due to its weight and a non-edge portion of a bottom surface of the top sheet remains in contact with a top surface of the following sheet;

moving at least one elongated separator from a front side of the stack facing the feed direction into a gap formed between the lifted edge of the top sheet and the corresponding edge of the following sheet; and moving the separator in the opposite direction of the feed direction between the top sheet and the following sheet in order to substantially separate the bottom surface of the top sheet from the top surface of the following sheet.

7. The method according to claim 6, wherein the device includes at least two separators positioned parallel to each other along a width of the stack.

8. A device for separation of sheets of a medium for feeding to a machine, wherein the sheets are kept in a stack for feeding to the machine in a feed direction and the top sheet of the stack is lifted from the following sheet on the stack at a front edge of the top sheet facing the feed direction and fed to the machine, the device comprising:

an advancement apparatus configured to advance the top sheet of the stack in the feed direction further than the following sheet on the stack;

a lifting apparatus configured to receive the top sheet from the advancement apparatus and lift the front edge of the advanced top sheet facing the feed direction from the following sheet such that a significant non-edge portion of a bottom surface of the top sheet remains in contact with a top surface of the following sheet; and at least one elongated separator at the front side of the stack facing the feed direction configured for movement in the opposite direction of the feed direction into a gap formed between the lifted edge of the top sheet and the following sheet in order to substantially separate the bottom surface of the top sheet from the top surface of the following sheet.

9. The device according to claim 8, wherein:

the lifting apparatus configured to lift the front edge of the top sheet comprises a sheet stopper; and the advancement apparatus further comprises a pusher configured to push the top sheet against the sheet stopper, which lifts the front edge of the top sheet.

10. The device according to claim 9, wherein the pusher traverses the top sheet with feed rollers.

11. The device according to claim 10, wherein the sheet stopper comprises at least one continuously moving belt and the pusher pushes the front edge of the top sheet against the at least one belt such that the at least one belt lifts the front edge of the top sheet.

12. The device according to claim 9, wherein the sheet stopper comprises at least one continuously moving belt and the pusher pushes the front edge of the top sheet against the at least one belt such that the at least one belt lifts the front edge of the top sheet.

13. The device according to claim 8, wherein each of the elongated separators comprises a steel band of small material thickness with a cross-section profile that provides an axial stiffening of the band.

14. The device according to claim 13, wherein at least one separator includes a gliding tip.

15. The device according to claim 8, wherein at least one separator includes a gliding tip.

16. The device according to claim 8, wherein at least one separator has a length sufficient to extend substantially along the entire length of the stack when advanced between the top sheet and the following sheet.

17. The device according to claim 8, wherein the device includes at least two separators positioned parallel to each other along a width of the stack.

18. The device according to claim 8, wherein the at least one separator conducts electricity and is grounded.

19. The device according to claim 8, wherein the at least one separator can be driven by a motor.

20. The device according to claim 19, wherein the motor is controlled such that the at least one separator is inserted at a first speed between the top sheet and the following sheet and is removed from the inserted position to a home position at a second speed that corresponds to a feeding speed of the top sheet, wherein the first speed is faster than the second speed.

* * * * *